US010056074B2

(12) United States Patent
Langdon et al.

(10) Patent No.: US 10,056,074 B2
(45) Date of Patent: Aug. 21, 2018

(54) TALKING MEDICINE BOTTLE AND LABEL AND SYSTEM AND METHOD FOR MANUFACTURING THE SAME

(71) Applicant: ACCESSAMED, INC., Normandy Park, WA (US)

(72) Inventors: Linda L Langdon, Normandy Park, WA (US); Chad Hazen, Vancouver, WA (US); David Lowell Seymour, Walla Walla, WA (US)

(73) Assignee: ACCESSAMED, INC., Normandy Park, WA (US)

( * ) Notice: Subject to any disclaimer, the term of this patent is extended or adjusted under 35 U.S.C. 154(b) by 345 days.

(21) Appl. No.: 13/964,061

(22) Filed: Aug. 10, 2013

(65) Prior Publication Data

US 2015/0046165 A1 Feb. 12, 2015
US 2017/0011731 A9 Jan. 12, 2017

Related U.S. Application Data

(63) Continuation-in-part of application No. 13/623,849, filed on Sep. 20, 2012, now abandoned.

(51) Int. Cl.

| | |
|---|---|
| ***G10L 13/00*** | (2006.01) |
| ***G10L 13/04*** | (2013.01) |
| ***A61J 1/03*** | (2006.01) |
| ***A61J 7/04*** | (2006.01) |
| ***B65B 1/30*** | (2006.01) |

(52) U.S. Cl.

CPC ..... *G10L 13/043* (2013.01); *A61J 1/03* (2013.01); *A61J 7/0481* (2013.01); *B65B 1/30* (2013.01); *A61J 2205/20* (2013.01); *A61J 2205/30* (2013.01); *A61J 2205/70* (2013.01)

(58) Field of Classification Search

USPC ..... 704/257–275

See application file for complete search history.

(56) References Cited

U.S. PATENT DOCUMENTS

| | | | | |
|---|---|---|---|---|
| 5,812,064 A * | 9/1998 | Barbour | A61J 1/03 | 340/5.91 |
| 5,852,803 A * | 12/1998 | Ashby, III | G09F 25/00 | 704/270 |
| 6,415,021 B1 * | 7/2002 | Oh | G06Q 10/107 | 379/88.13 |
| 8,249,889 B2 * | 8/2012 | Lyons | G06F 19/3462 | 705/2 |
| 2006/0173564 A1 * | 8/2006 | Beverly | G11B 31/02 | 700/94 |
| 2008/0111685 A1 * | 5/2008 | Olson | B65D 55/028 | 340/545.6 |
| 2013/0110516 A1 * | 5/2013 | Abulhaj | G10L 21/00 | 704/274 |

* cited by examiner

*Primary Examiner* — Jesse Pullias
(74) *Attorney, Agent, or Firm* — Mark E. Beatty; Rylander & Associates PC

(57) ABSTRACT

A talking medicine label, bottle, system and method for their manufacture are described. The system and method include use of a recording device by speaking into a microphone and then affixing the talking label to the side of a conventional pill bottle to transform it into a talking pill bottle. The system and method alternatively may include a PC/POS terminal and a speech synthesis device for programming the label with a synthetic-speech recording.

7 Claims, 12 Drawing Sheets

TALKING MEDICINE BOTTLE AND LABEL AND SYSTEM AND METHOD FOR MANUFACTURING THE SAME

RELATED APPLICATIONS

This application is a continuation-in-part (CIP) of and claims the benefit of priority to U.S. patent application Ser. No. 13/623,849, filed Sep. 20, 2012 and titled TALKING MEDICINE BOTTLE AND LABEL AND SYSTEM AND METHOD FOR MANUFACTURING THE SAME, the entire disclosure of which is incorporated herein by this reference.

FIELD OF THE INVENTION

The invention relates generally to the field of prescription medicine bottles for non-English reading pharmacy customers. More particularly, the invention relates to a medicine bottle for use by persons who cannot read the label on the bottle for whatever reason.

BACKGROUND OF THE INVENTION

Blind or visually impaired (B/VI) persons have trouble reading medicine bottle labels at the risk that they take the wrong medicine or the wrong dosage of the right medicine. A growing US population will suffer vision impairment from diabetes. Another large population will suffer vision impairment from injury. Finally, a large and aging baby boomer population is expected to suffer vision impairment by way of a progressive disease called macular degeneration. But the problem is not only with B/VI persons. The same inability to read medicine bottle labels exists for persons who do not read the language in which the prescription on the label is printed. It is estimated that a growing US population of thirty million people cannot read English, and it is estimated that 41% of the US population cannot read third-grade English and thus are functionally illiterate. Safety thus is a great concern for such persons.

The Americans with Disabilities Act (ADA) requires that reasonable accommodations be made for persons with disabilities such as B/VI. It is impractical to accommodate such B/VI persons by printing the medicine bottle label in Braille for two reasons: 1) The prescription printed in Braille would not fit in the space provided on a conventional medicine bottle label, and 2) only approximately 10% of the B/VI population in the United States can read Braille. Clearly, other accommodations are needed to avoid or minimize the risk of injury or death to a person who cannot read a medicine bottle label's prescription.

Talking medicine bottles recently has been proposed by RxMed, Inc. as a solution to a niche, glucose-monitoring medication labeling problem. But the proposed solution is impractical in that few if any pharmacies are willing to stock large inventories of different empty medicine bottles, one inventory for the sighted and one inventory for the B/VI or reading-challenged. Moreover, the proposed solution is bulky and expensive, as it requires a special auxiliary reader base to be purchased and placed in the home of each user, and to be programmed the bottle must be programmed in the user's home by a trusted, sighted, and literate in-home companion or partner. Thus, even aside from nearly prohibitive cost, the proposed solution is cumbersome and the user's safety and independence are compromised.

Talking greeting cards and books are available that utilize a recordable voice module (into which a person speaks) that, when played back, audibly repeats the recorded greeting and/or text.

On Jul. 9, 2012, President Barack Obama signed into law the Food and Drug Administration Safety and Innovation Act requiring US pharmacies to provide prescription medicines with important information on their prescription labels that specifically accommodate B/VI customers. This recent legislation underscores the ADA's already existing "reasonable accommodations" mandate.

DETAILED DESCRIPTION OF THE EMBODIMENTS

The invention relates to the design and manufacture of "audio" or talking labels primarily for products that require prescription labeling. Specifically, the invention provides a solution to the B/VI community that allows them to safely and independently identify their prescriptions contained in medication packaging. The invention will have applications for the B/VI community beyond prescription labeling, including but not limited to non-prescription medication and other products.

"Label" as used herein refers broadly to a recorded and/or printed label configured to be affixed to a surface of a medicine bottle. "Digital audio label" or "Talking label" as used herein refers broadly to a label containing and emitting recorded utterances that include information about a product contained within a package to which the talking label is affixed. "Talking medicine bottle label" or "talking pill bottle label" as used herein refers broadly to a talking label containing and emitting recorded medicinal prescription information including one or more of patient name, medicine name, prescribed dosage, prescription filler's (e.g. pharmacy's) phone number, and the like.

ACCESSAMED™ is a trademark owned by the assignee of the present invention, Accessamed, Inc. World-wide rights are reserved.

Figure 1:
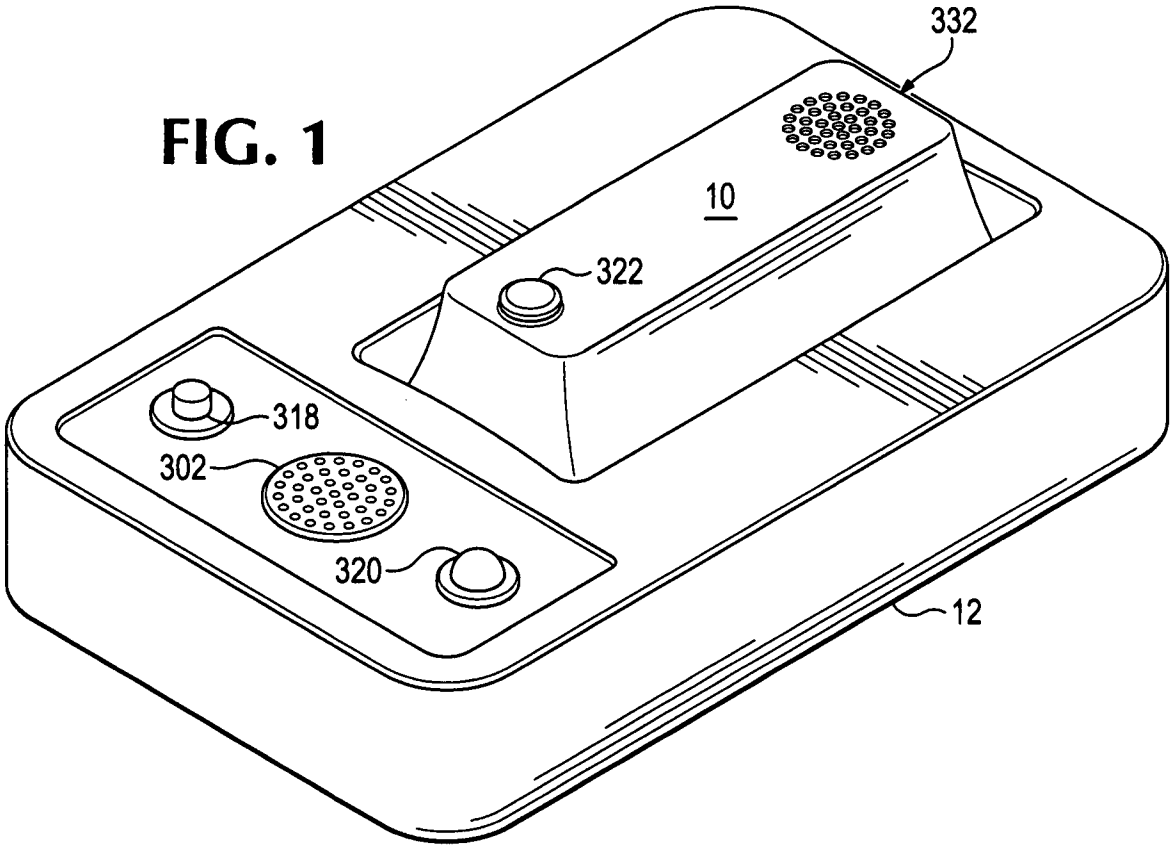
FIG. 1 is an isometric view of the invented medicine bottle's talking label coupled with a recording device therefor, in accordance with one embodiment of the invention.

FIG. 1 is an isometric view of the invented medicine bottle's talking label and a recording device therefor, in accordance with one embodiment of the invention. Talking label 10 including a miniature voice module may be seen from FIG. 1 to take the form of an elongate strip that includes encapsulated microelectronics and externally accessible user controls such as pushbuttons to be described in detail below by reference to FIG. 3. Label 10 may be seen to be programmable on demand by the use of a docking platform or recording device 12 to which it is momentarily coupled. In accordance with one embodiment of the invention, a prescription filler, e.g. a pharmacy technician or pharmacist, very simply ports a blank pill bottle label on the recording device as shown in FIG. 1, momentarily depresses a RECord pushbutton or the like, and speaks the contents of the printed label into a microphone provided on the recording device. As a result, label 10 will be understood to contain an actual-voice or synthetic-voice recording that is programmable by any of one or more techniques described and illustrated herein or otherwise suitable, and to be capable of playing back such a recording on demand, e.g. when a patient momentarily depresses a PLAYback pushbutton or the like. The present application records in label 10 a prescription medication's patient name, drug name, drug dosage, and ingestion instructions for a prescription medication bottle charged with the prescribed pills and affixed with the label. Thus, patients who cannot read the printed prescription bottle label nevertheless can safely and independently take their meds.

Those of skill in the art will appreciate that recording device 12 can take various forms, as will be described. For example, it may take the form of a microphone into which a technician speaks to produce an actual voice recording in a digital (e.g. a WAV file) or analog form. Alternatively, it may take the form of a USB or Ethernet or IEEE802 local area network (LAN) or a wireless, e.g. BlueTooth or WiFi or other like radio frequency (RF) or infrared (IR), port on the label itself that is operatively coupled with a transmitter that effectively conveys a digital or analog signal thereto representing a synthetic voice recording. Such a transmitter may be coupled with a remote, general web-based server (e.g. in a so-called "cloud" or shared-servers web architecture) or may be coupled instead with a local, dedicated pharmacy point-of-sale (POS) terminal, e.g. a cash register. Such prescription and patient data if conveyed over the airwaves can be encrypted and otherwise protected against piracy or corruption in compliance with patient privacy, e.g. the 1996 Health Insurance Portability and Accountability Act (HIPAA), or other security protocols. Such data can also be error-checked and/or error-corrected to ensure its integrity and accuracy at the receiving/recording/labeling end.

An even more compelling alternative to speaking into a recording device is to automatically program the talking label from a pharmacy POS terminal using an intermediate USB-ported (or otherwise wired or wirelessly connected as described above) recording device that directly converts the printed label information resident in the POS terminal into synthesized speech for recording of the same into the talking label. This system architecture would not require changes to the talking label itself, would use the same spring contact interface for electrical coupling of the talking label with the recording device, and would thus place any incremental cost on the relative few recording devices themselves instead of on the relatively many talking labels. Such a system and method for manufacturing the invented talking medicine bottle and label would keep costs to a minimum, and would further reduce the burden of labor and time consumption on the pharmacy at only slightly greater recording device cost. This seems an extremely attractive alternative to the manual recording scheme, especially since millions of prescriptions are filled daily by pharmacies across the US.

Those of skill in the art will appreciate that label 10 is programmed in any suitable manner to describe the contents of the medicine or pill battle to which it is affixed. In order for the spoken content description to be reliable, it must be accurate and understandable when played back. To this end, it is contemplated that a verification step should be a part of every prescription fulfillment process. Such a verification step typically would include playing back and listening to the recorded contents of the label and double-checking the same against the printed label and/or the prescription slip itself. Such a cautionary step typically might be performed by a different person from the one who created the recorded contents, to avoid personal bias and predisposition. For example, a pharmacy technician might produce the recording using the RECord pushbutton, and then a pharmacist might verify the recording by using the PLAYback pushbutton. Those of skill in the art will appreciate that label 10, in accordance with one embodiment of the invention, can be programmed or recorded only when it is attached to recording device 12 such that, once recorded, the prescription contents cannot be changed by the patient.

In accordance with one embodiment of the invention, the talking label including its external skin and adhesive layer is only approximately 5 centimeters (5 cm) (2 inches) high, approximately 1.27 cm (0.5 inch) wide, and approximately 1.1 cm (0.43 inch) thick. Thus, all of the speech capability of the invented talking label fits in a volume that is less than approximately 6.5 $cm^3$ (0.4 cubic inch or $in^3$). This represents extremely high functional density for a value proposition that enables B/VI persons safely, accurately, regularly, independently, and repeatedly to take their prescription meds. Alternative forms and dimensions, of course, are contemplated as being within the spirit and scope of the invention. Those of skill in the art will appreciate that configuring label 10 in the form of an elongate, relatively narrow strip enables it to be more readily and securely affixed to the outside cylindrically arcing surface of a typically cylindrical plastic medicine bottle of any conventional size.

Those of skill in the art will appreciate that the invention lends itself to alternative applications, e.g. the talking label described and illustrated herein, with perhaps only minor shape and/or size changes could be used by a B/VI person to label any household object, e.g. a mobile phone, a notebook computer, a CD or DVD case, a toothbrush, a drinking glass, a bath towel, a garment, etc. Such alternative talking object labels are contemplated as being within the spirit and scope of the invention. Those of skill in the art will appreciate that, in accordance with this alternative but contemplated embodiment of the invention, the functions of recording device 16 can be incorporated in the talking label itself.

Figure 2:
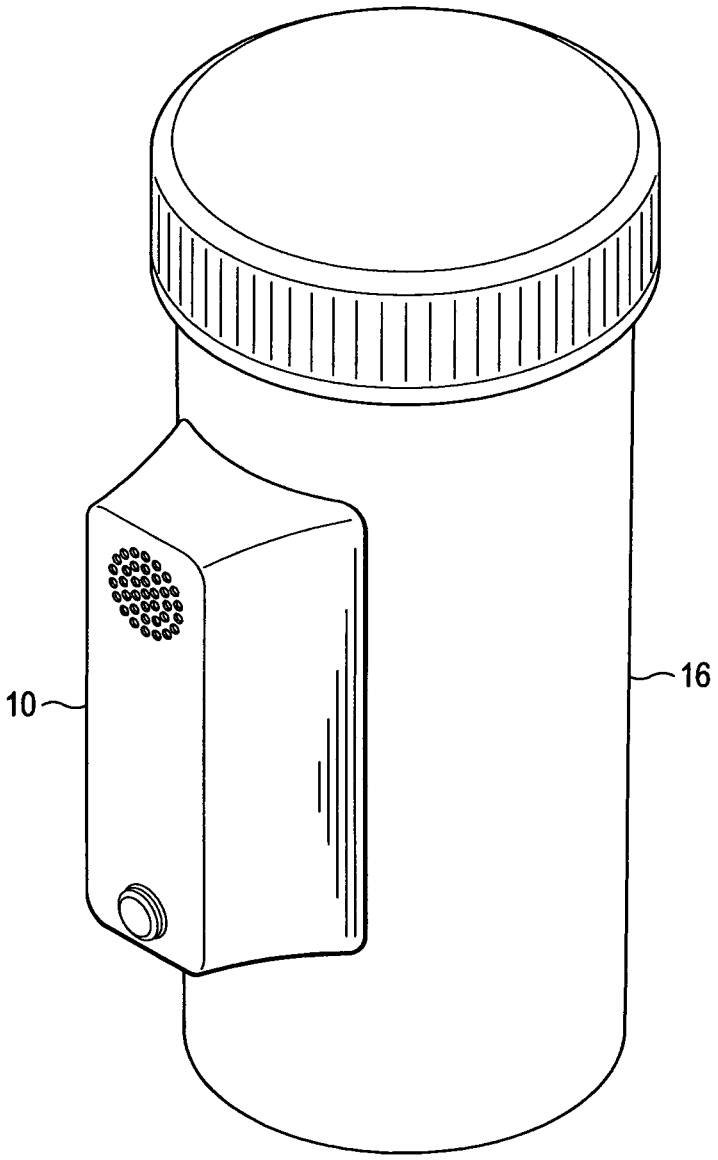
FIG. 2 is an isometric view of the invented medicine bottle's talking label affixed to a medicine bottle filled with a prescription medication to provide a talking medicine bottle, in accordance with another embodiment of the invention.

FIG. 2 is an isometric view of the invented medicine bottle's talking label 10 affixed to a talking medicine bottle 16 filled with a prescription medication to provide a talking medicine bottle, in accordance with another embodiment of the invention. Those of skill will appreciate that label 10 is prepared with an adhesive backing strip that configures it to be at least semi-permanently and preferably permanently affixed to bottle 16. Those of skill in the art will appreciate that, once programmed, talking label 10 medicine bottle 16 in accordance with one embodiment of the invention are self-contained, all-in-one, stand-alone products requiring no external reader. Those of skill in the art also will appreciate that talking label 10 and medicine bottle 6 are inexpensive, lightweight, and easily used, in contrast to the solution proposed by RxMed, Inc.

Those of skill in the art will appreciate that label 10 alternatively can take the form of a nominally planar but flexible, relatively broader expanse that is compatible with affixing to a wider cylindrically arcing surface of a cylindrical medicine bottle. For example, it is contemplated that the circuitry within label 10 can be further micro-miniaturized and further integrated, e.g. surface mounted, surface printed, or even embedded onto, into, or even within a flexible circuit board (a so-called "flex circuit" containing, for example, piezoelectric push or capacitive touch control buttons) an outside surface of which might bear the traditional printed prescription information. Thus the present invention contemplates further miniaturization and/or integration of printed and talking labels for medicine bottles.

Those of skill in the art will appreciate that the talking label and its printed label equivalent can be color coded to one another to ensure accuracy and repeatability in programming, labeling, and use (to the extent that a B/VI patient can distinguish colors) thereof. This would meet the error-avoidance, duplicate color-coded label guidelines suggested by the National Federation of the Blind (NFB).

Figure 3:
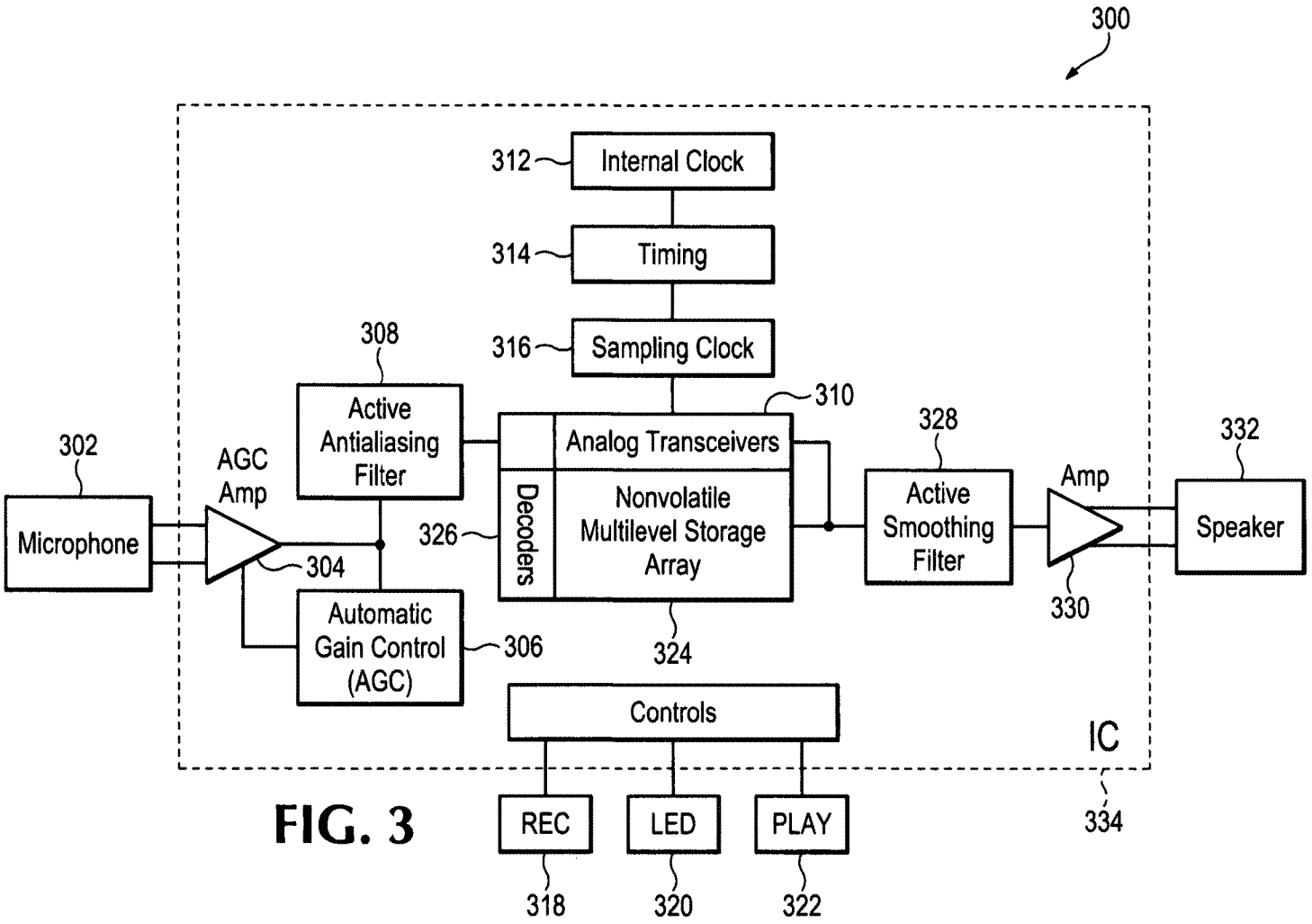
FIG. 3 is a detailed schematic block diagram of the electromechanical aspects of the talking pill bottle label shown in FIGS. 1-2.

FIG. 3 is a detailed schematic block diagram of the electrical aspects of the internal electronics 300 of talking pill bottle label 10 and recording device 12 shown in FIGS. 1 and 2. Electronics 300 may be seen to include a tiny microphone 302 within recording device 12, an automatic gain control (AGC) input amplifier (Amp) 304 with closed-loop AGC 306 feedback, an active anti-aliasing filter 308, and a set of analog transceivers 310. Electronics 300 also include an internal clock 312, a timing circuit 314, and an analog signal sampling clock 316 that establishes the periodicity of the sampled voice signal output of filter 308. Electronics 300 also include a record (REC) pushbutton 318 within recording device 12, a tiny light-emitting diode (LED) status indicator 320 also within recording device 12, and a playback (PLAY) pushbutton 322 within talking pill bottle label 10 (collectively referred to herein as "controls") for use by a pharmacy technician and/or user of talking pill bottle label 10.

Those of skill in the art will appreciate that LED 320 within recording device 12 in accordance with one embodiment of the invention is used to indicate to the pharmacy technician that the talking pill bottle label ported therein for programming purposes is in RECord mode, as by blinking during the recording and as by steady illumination when RECording is complete. Other uses of status LED 320 within recording device 12 are contemplated as being within the spirit and scope of the invention.

Electronics 300 also include a non-volatile multi-level storage array 324 (referred to herein as a programmable memory) for storing a recording in digital form in accordance with a set of decoders 326. The digitized output of transceivers 310 and storage array 324 are smoothed by an active smoothing filter 328 and the resulting signal is amplified by an output amplifier (Amp) 330. The output of Amp 330 is rendered audible by a speaker 332.

It has been determined that the rating of microphone 302 should be approximately 45 decibels (db). It has also been determined that the sound-pressure level (SPL) of the output of speaker 332 should be between approximately 40-60 db. Those of skill in the art will appreciate that a desirable SPL represents a trade-off between the size of the speaker (and thus the tiny talking pill bottle label) and the volume and quality of the recorded speech (and thus audibility in use at arm's-length).

Not shown in FIG. 3, for the sake of clarity and brevity, is how label 10 is powered and controlled. In accordance with one embodiment of the invention, two tiny coin batteries B1 and B2 are used to provide DC power to the electronic components requiring the same. Also in accordance with one embodiment of the invention, a simple microprocessor or control store performs the required control functions including, for example, scanning the control pushbuttons for an edge transition, driving the status LED, and controlling the speech functions including RECord and PLAYback. Those of skill in the art will appreciate that the DC power and control functions can be implemented in alternative ways (e.g. the power source can be a capacitor or suitable alternative, and the controller can be a programmable logic array (PLA) or gate array or suitable alternative). Any and all such alternatives are contemplated as being within the spirit and scope of the invention. Those of skill in the art also will appreciate that such control functions are straightforwardly programmed into a digital processor using existing software tools and algorithms.

In accordance with one embodiment of the invention, all of the functional blocks within electronics 300 are integrated into a single integrated circuit (IC) 334, with the exception of microphone 302 (which resides within programming device 12); controls 318, 320, and 322; and speaker 332 (which resides within talking pill bottle label 10). Thus, the speech RECord and PLAYback functions of blocks 304, 306, 308, 310, 312, 314, 316, 324, 326, 328, and 330 are combined in a single IC that is relatively compact. Indeed, those of skill in the art will appreciate that the single IC may be embodied in a die form for chip-on-board (COB) embodiment for an even less expensive and more compact pill bottle label configuration, in accordance with future embodiments contemplated as being within the spirit and scope of the invention. At the same time, the thickness of the printed circuit board (PCB) may shrink from approximately 1.57 mm (0.062 inch) to approximately 0.81 mm (0.032 inch), thus providing an overall talking pill bottle label that is even more compact than that described and illustrated herein. Those of skill in the art also will appreciate that printed or discrete passive devices such as resistors and capacitors and spring contacts may be included to provide an appropriate filter cutoff frequency, analog speech sampling rate, and reliable electrical connections (the placement and values of which are deemed to be within the ordinarily skilled person's straightforward capability to determine).

Those of skill will appreciate that, in accordance with one embodiment of the invention, the electrical circuitry within talking label 10 and recording device 12 are partitioned in a unique way: All active circuitry is located within talking label 10, while only passive circuitry is located within recording device 12. In other words, only resistors and capacitors and contacts are found in recording device 12, which passive circuitry during a recording operation is powered by DC power from batteries B1 and B2 that are located within talking label 10. Thus, recording device 12 requires no DC power source whatsoever to be a part of its partitioned circuitry. Effectively, the playback device provides power to the recording device in what is thought to be a uniquely reversed power supply scheme.

In accordance with one embodiment of the invention, the sampling rate is selected to be approximately 10,700 samples per second, or 10.7 kiloHerz (kHz). This sampling rate has been found to produce reasonably high quality speech recordation and reproduction, without over-taxing multi-level storage array 324 yet while providing up to approximately 15 seconds or more of recorded monaural speech. Those of skill in the art will appreciate that, within the spirit and scope of the invention, alternative speech sampling rates and memory sizes and speech segment lengths can be accommodated.

Those of skill in the art also will appreciate that edge transition PLAYback pushbutton switch electronics have been described in accordance with one embodiment of the invention to make it easier for a B/VI person with arthritis or other motor skill problems or feebleness nevertheless quickly and easily to activate the pushbutton switch by only momentary rather than continuous switch pressure. The PLAYback pushbutton switch can be momentarily depressed, and the entire recorded prescription information is played back, unless the user depressed the switch again, in which case PLAYback is restarted from the beginning. In accordance with one embodiment of the invention, PLAYback switch 322 is a soft-foam-covered tactile switch requiring relatively little pressure by the user's finger or thumb.

Those of skill will appreciate that there is no RECord pushbutton switch on talking label 10 or talking bottle 16, in accordance with one embodiment of the invention. This eliminates the possibility of a user inadvertently and undesirably erasing or over-recording the voiced prescription.

Those of skill will appreciate that the electronic components shown in FIG. 1 can be differently implemented or their functions differently grouped, within the spirit and scope of the invention. In accordance with one embodiment of the invention, the component parts are logically grouped and integrated into one or more tiny integrated circuit (IC) modules that are surface mounted to a tiny printed circuit board bearing plural printed circuit runs or so-called lands for signal interconnection. In accordance with one embodiment of the invention, such integrated circuits include a miniature voice module including the microphone, speaker, and analog/digital conversion/recording circuitry and a control module including the tiny pushbuttons and LED status indicator. Thus, a high level of circuit integration is contemplated that produces high functionality in a tiny volume that is compatible with use of the talking label with a conventional, relatively small prescription medicine bottle. No special medicine bottle inventories are required of the pharmacy and thus the costs attendant thereto are reduced while V/BI customers' safety is increased.

Figure 4:
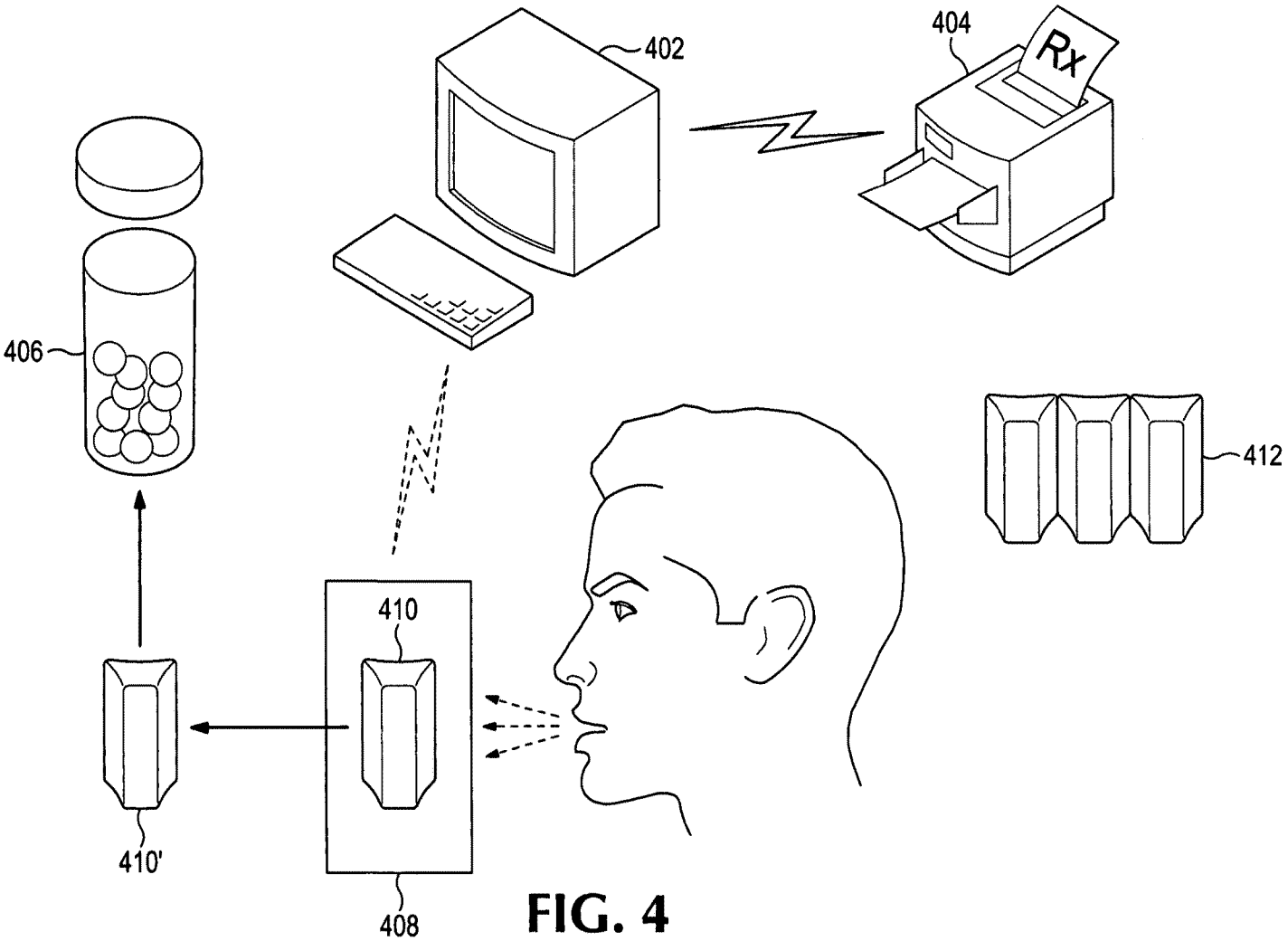
FIG. 4 is a system block diagram illustrating the system for manufacturing the talking medicine bottle's talking label and talking medicine bottle bearing such a talking label shown in FIGS. 1-2 in accordance with yet another embodiment of the invention.

FIG. 4 is a system block diagram illustrating the system for manufacturing the talking medicine bottle label and medicine bottle bearing such a talking label shown in FIGS. 1-3 in accordance with yet another embodiment of the invention. The invented system 400 includes a POS terminal 402 located within a pharmacy or clinic or hospital, a networked or directly connected paper Rx label printer 404, at least one conventional pill bottle 406, a recording device 408 coupled with a ready-to-record talking label 410, and one or more blank talking pill bottle labels 412. Those of skill in the art will appreciate that recording device 408 and ready-to-record talking label 410 may be the same as recording device 12 and talking label 10 of FIGS. 1 and 2.

Those of skill in the art will appreciate that one embodiment of the system 400 for manufacturing talking labels may include a POS terminal 402 that takes the more prevalent alternative form of a smart phone-type device providing a wired or wireless (e.g. RF or IR) connection to the programmer or recording device. Thus, the POS terminal 402 of FIG. 4 need not, within the spirit and scope of the invention, take the more conventional cash register form suggested in FIG. 4.

Figure 5:
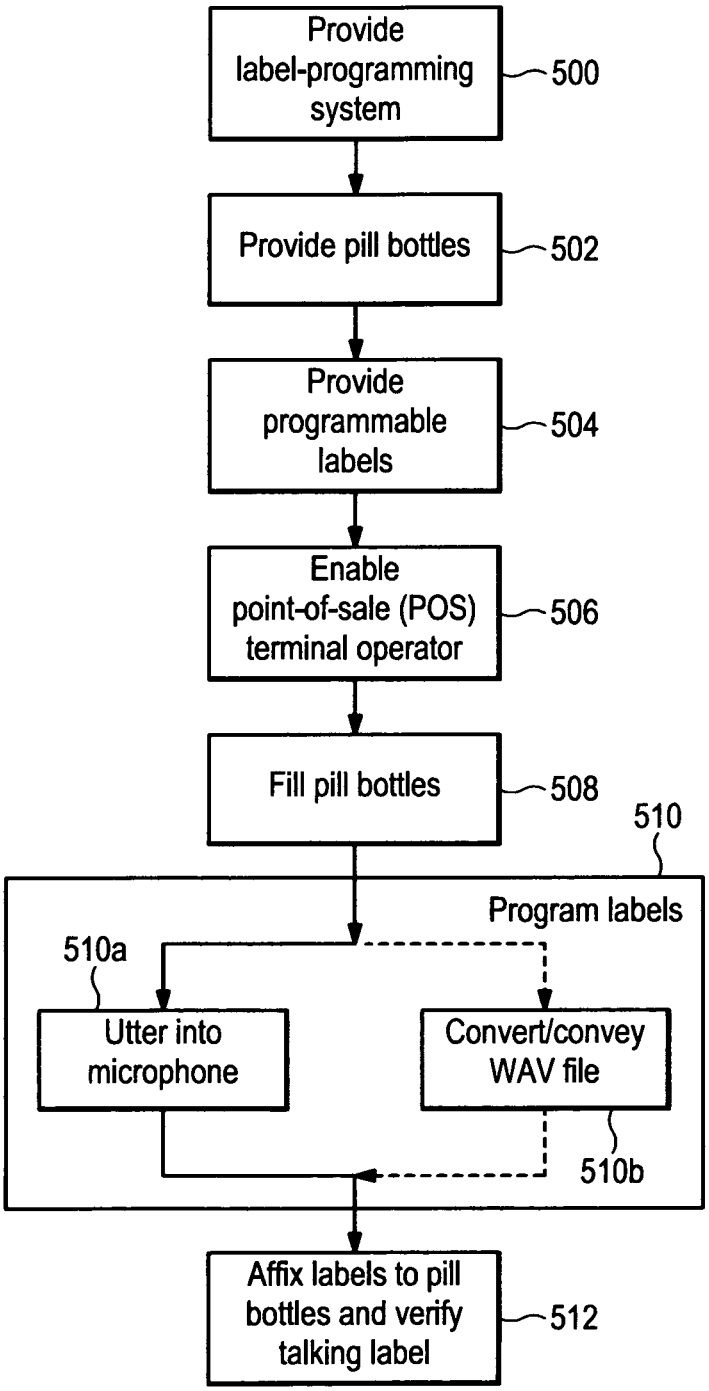
FIG. 5 is a flowchart illustrating the method for manufacturing the medicine bottle label and medicine bottle bearing such a talking label shown in FIG. 1-3 or 7-10, in accordance with still another embodiment of the invention.

A prescription filler represented in FIG. 5 by a talking head either speaks into the microphone of the recording device or causes the recording device, responsive to receipt of a synthesized speech record from the POS terminal, as indicated by dashed lines. The talking label thereafter contains prescription information corresponding to the pills contained within the pill bottle. It will be understood that the recorded talking label 410' is then moved from the recording device to the side of the talking pill bottle and affixed thereto, as by removing a protective film from the double-sticky-back tape that extends along an inner, preferably curved surface of the talking label. The printed label then is affixed to another portion of the talking pill bottle, thus rendering the talking pill bottle ready for use by the prescription patient who may be B/VI or who may otherwise not be able to read the printed pill bottle label.

Those of skill in the art will appreciate that the invented system can be used with minor modifications to affix talking labels to over-the-counter medications. In such case, the POS terminal might instead be a simple controller within a medication manufacturing factory, and the conventional pill bottle to which the invented talking label 10 may be adapted for use might instead be a so-called medical blister pack or similar retail, mass-market pill package. The label could of course take a different shape that is more compatible with a generally planar blister-pack pill package. Those of skill in the art will appreciate that such is contemplated as being within the spirit and scope of the invention.

FIG. 5 is a flowchart illustrating the method for manufacturing the medicine bottle's talking label and a talking medicine bottle bearing such a talking label shown in FIGS. 1-3, in accordance with still another embodiment of the invention. The invented method includes providing a label-programming system to a pharmacy at 500; providing conventional empty pill bottles to the pharmacy at 502; providing programmable labels to the pharmacy at 504; enabling POS terminal operator, e.g. a pharmacy technician, to print conventional labels and to program the invented talking labels at 506; and filling the pill bottles with prescription medication at 508. The invented method further includes programming the invented labels at 510 either by a) uttering the prescription information into a microphone at 510*a* or by b) converting (as by any suitable digital input-file-to-speech-output-file technique) and conveying (whether wirelessly or otherwise) suitably synthesized speech (e.g. as WAV or other suitable data), the actual or synthetic speech being recorded into the memories of each of the the respective invented labels.

Those of skill in the art will appreciate that the input file from POS terminal 402 (refer briefly back to FIG. 4) may be any suitable digital file including, for example, a text file, a file output by an optical character recognition (OCR)-based printed-label text or bar-code reader, or a file of any suitable type capable of being translated into a speech output file. Those of skill also will appreciate that translation of such a printed-label's text or bar code can be assisted by a local or remote database or other table look-up or other suitable translation technique.

The invented method at 512 further includes affixing the talking labels to the respective pill bottles and verifying the talking labels' respective contents to ensure that each audibly and accurately describes the prescription information corresponding to the printed label and the bottle and its contents. As described herein, a pharmacy's protocol may include having a different person verify the contents than the person who filled the prescription and recorded the talking labels. Those of skill in the art will appreciate that one or more of the invented method steps may be re-ordered, combined, or omitted in an suitable way that is within the spirit and scope of the invention.

Figure 6A:
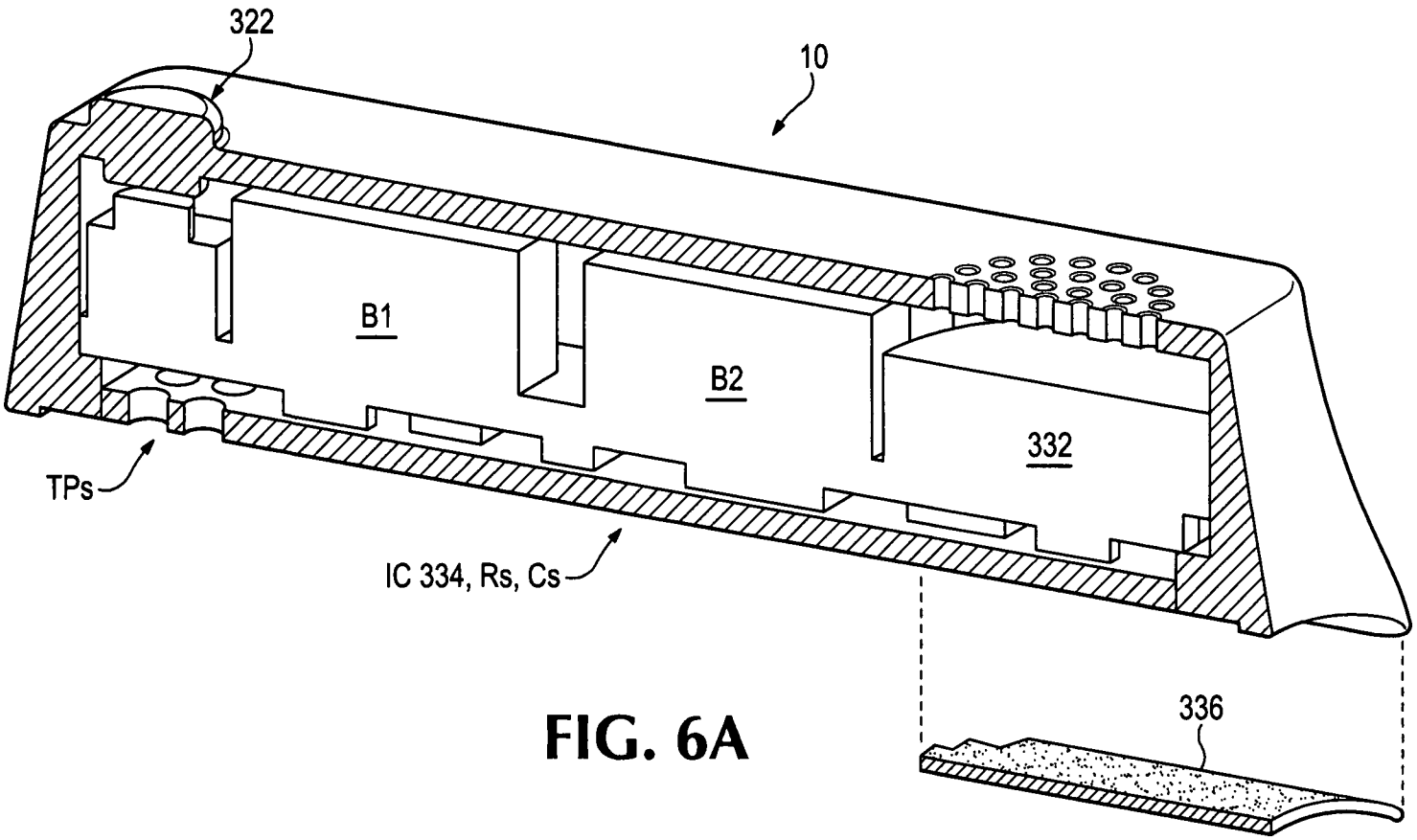
FIGS. 6A and 6B are cut-away isometric views of the invented talking label by itself and of the talking label ported for prescription-contents recordation in the recording device, respectively.
Figure 6B:
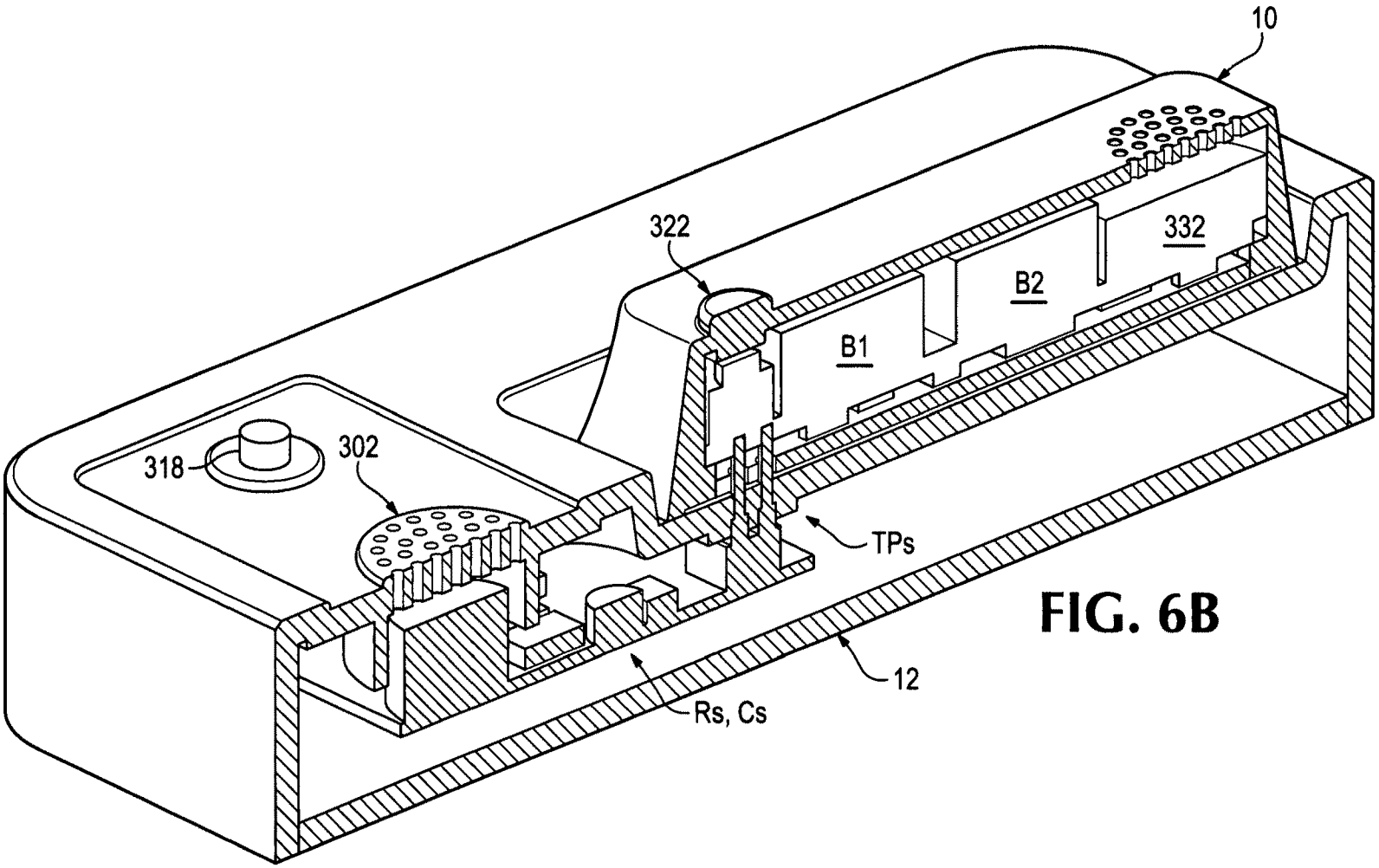

FIGS. 6A and 6B are schematic, cut-away isometric views of the invented talking label by itself and of the talking label ported for prescription recordation in the recording device, respectively. Those of skill in the art will appreciate that the schematic diagrams do not explicitly show the components' outlines or borders. Instead, in the interest of clarity, the components' placement and orientation generally are shown within the packaged enclosure representing talking bottle 12 and/or recording device 16. For example, the printed circuit board (PCB) mounting the various components are not explicitly shown in FIGS. 6A and 6B but will be understood to be a single- or double-sided or multilayer printed circuit board containing ground planes, signal runs, and mounting pads or through holes to which electrical components are mounted for electrical interconnection in accordance with FIG. 3. Those of skill also will appreciate that FIGS. 6A and 6B show the cut-away components generally with cross-hatch lines at the cut-away plane, but that, for the sake of clarity, such cross hatch lines are omitted from talking label 10.

FIG. 6A illustrative of the invented pill bottle label shows its component parts and packaging details. Batteries B1 and B2, PLAYback switch 322, and speaker 332 may be seen to be mounted on a first surface of a PCB the opposite surface of which may mount discrete components such as IC 334, resistors (Rs) and capacitors (Cs), and spring terminal contacts (TPs), all fitted within a tiny housing having a curved inner surface. Those of skill in the art will appreciate that the housing may be made of any suitably durable but resilient material such as a soft-foam polymer, and that in accordance with one embodiment of the invention, a double-sided adhesive layer 336 is affixed to the curved inner surface of the housing that generally conformingly mates a cylindrical pill bottle's outer surface. Alternative component placement and packaging are contemplated as being within the spirit and scope of the invention.

FIG. 6B illustrative of the invented pill bottle ported with the invented recording device shows their component parts and packaging details. Those of skill will appreciate that talking label 10 in FIG. 6B is the same as described above, but is shown in a different orientation coupled within a generally conforming recess within recording device 12. Recording device 12 may be seen to include microphone 302, RECord pushbutton (and associated switch there beneath but obscured in FIG. 6B), trim resistors Rs and capacitors Cs, and spring contacts TPs that provide for the needed electrical interconnections between recording device 12 and talking label 10, all of which are, in accordance with one embodiment of the invention, are mounted to a printed circuit board (PCB) not explicitly shown for the sake of clarity.

The TPs (or their otherwise-suitable electrical interconnection alternatives) described and illustrated herein in accordance with one embodiment of the invention convey the following signals between talking label 10 and recording device 12:

- Power (Direct current (DC) power supply)
- Ground (Power return path)
- LEDn (LED output remains low during RECord and blinks during PLAYback)
- Recn (edge-transitions from high to low and stays low during RECord, returns to high when RECord stops
- Mic+ (microphone positive input: conveys audio signal to preamplifier; AGC controls preamplifier gain; internal-to-IC and external Rs and Cs combine to form a low-frequency cutoff for the IC's passband)
- Mic− (microphone negative input: conveys inverted audio input signal to preamplifier; provides input noise cancellation or common mode rejection (CMR) at a desired common mode rejection ratio (CMMR))

Thus in accordance with one embodiment of the invention, only six signals and corresponding TPs or connectors are required to fully configure the talking label and recording device with the full functionality described and illustrated herein. Those of skill in the art will appreciate that alternative signals, signal sets, signal definitions, signal levels, signal transitions, and number of signals (and their corresponding number of TPs) are contemplated as being within the spirit and scope of the invention.

Those of skill in the art will appreciate from FIG. 6B that further miniaturization of speaker 332 of talking label 10 would enable batteries B1, B2 and PLAYback switch 322 to be shifted away from the proximal end of the PCB, thereby opening up an area thereat where edge connectors might be used to provide the needed electrical interconnections with recording device 12. Such an alternative speaker-shrinking and use of alternative connectors instead of or in addition to PCB-shrinking is contemplated as being within the spirit and scope of the invention. Thus, alternative placement and configuration and integration of the components of talking label 10 and recording device 12 are contemplated as being within the spirit and scope of the invention.

An alternative embodiment of the invention is described below by reference to FIGS. 7-10 and 11A-11B. Those of skill will appreciate that identical features are designated identically while similar features are designated similarly, e.g. by suffixing the similar feature shown in FIGS. 1-3 and 6A-6B, e.g. talking label 10, of the first embodiment with primes ('s) in FIGS. 7-10 and 11A-11B, e.g. alternative talking label 10' of the alternative embodiment. Those of skill in the art will appreciate that the second embodiment of the invention described below by reference to FIGS. 7-10 and 11A-11B will be described for the sake of brevity by way of highlighting the differences between the second embodiment and the first embodiment described above by reference to FIGS. 1-3 and 6A-6B.

Figure 7:
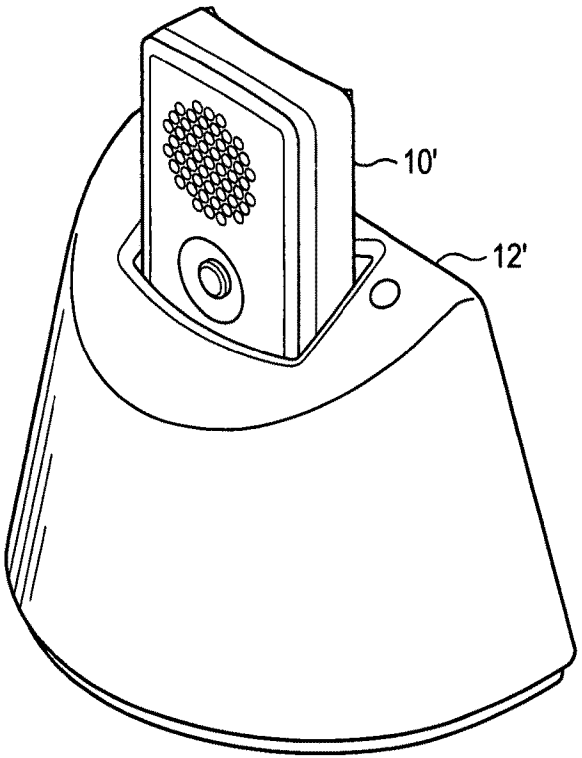
FIG. 7 is is an isometric view of the invented medicine bottle's talking label coupled with a recording device therefor, in accordance with an alternative embodiment of the invention.

FIG. 7 is is an isometric view of the invented medicine bottle's talking label (also referred to herein as a voice module) 10' coupled with a recording device or docking station 12', in accordance with an alternative embodiment of the invention.

Figure 8:
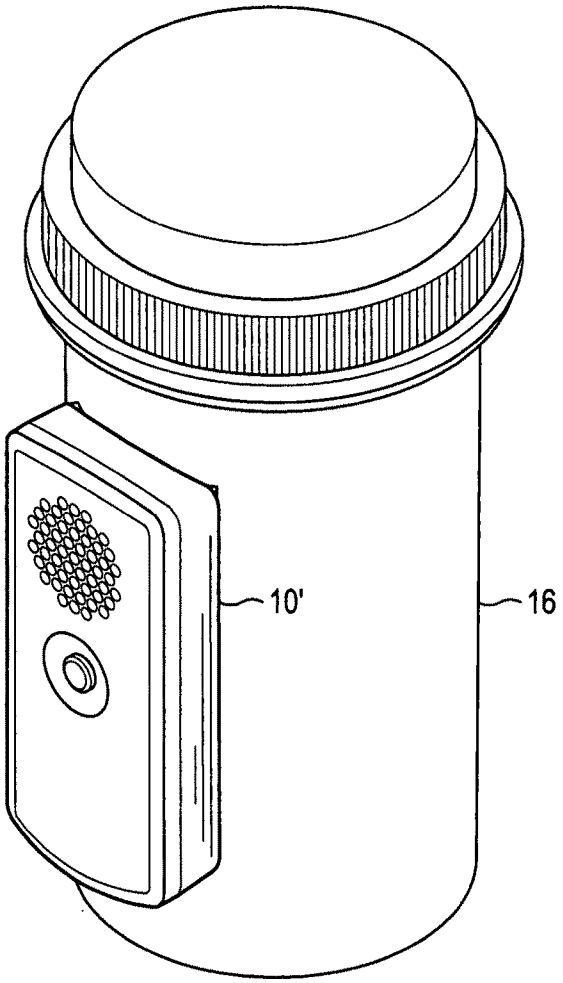
FIG. 8 is an isometric view of the invented medicine bottle's talking label affixed to a medicine bottle filled with a prescription medication to provide a talking medicine bottle, in accordance with an alternative embodiment of the invention.

FIG. 8 is an isometric view of the invented medicine bottle's talking label 10' affixed to a medicine bottle 16 filled with a prescription medication to provide a talking medicine bottle, in accordance with an alternative embodiment of the invention.

It may be seen from FIGS. 7-8 that talking label 10' features a recessed PLAYback pushbutton 322' and a slightly larger speaker 332'. (Those of skill in the art will appreciate that recessing pushbutton 322' reduces the likelihood of its being inadvertently actuated while carried talking pill bottle 10' is carried in a pocket, purse, backpack, fanny-pack, luggage, or the like.) It may also be seen that docking station 12' features an LED 320 but no pushbutton and no speaker. Those of skill in the art will appreciate that no pushbutton and no speaker are required in this alternative embodiment of docking station 12' because conversion and recording in memory of printed-label information into synthesized, digital speech form is initiated and accomplished automatically under control of a POS terminal or personal computer (PC) that is typically located within a pharmacy for ringing up prescription sales and printing traditional bottle labels.

Figure 9A:
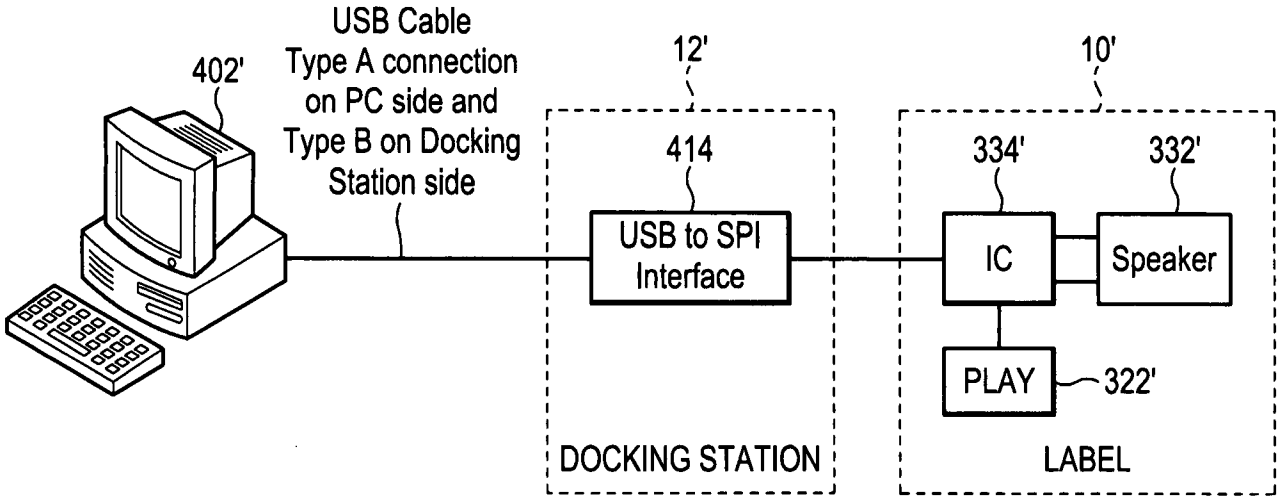
FIGS. 9A and 9B are a detailed schematic block diagram of the electromechanical aspects of the talking pill bottle label shown in FIGS. 7-8.
Figure 9B:
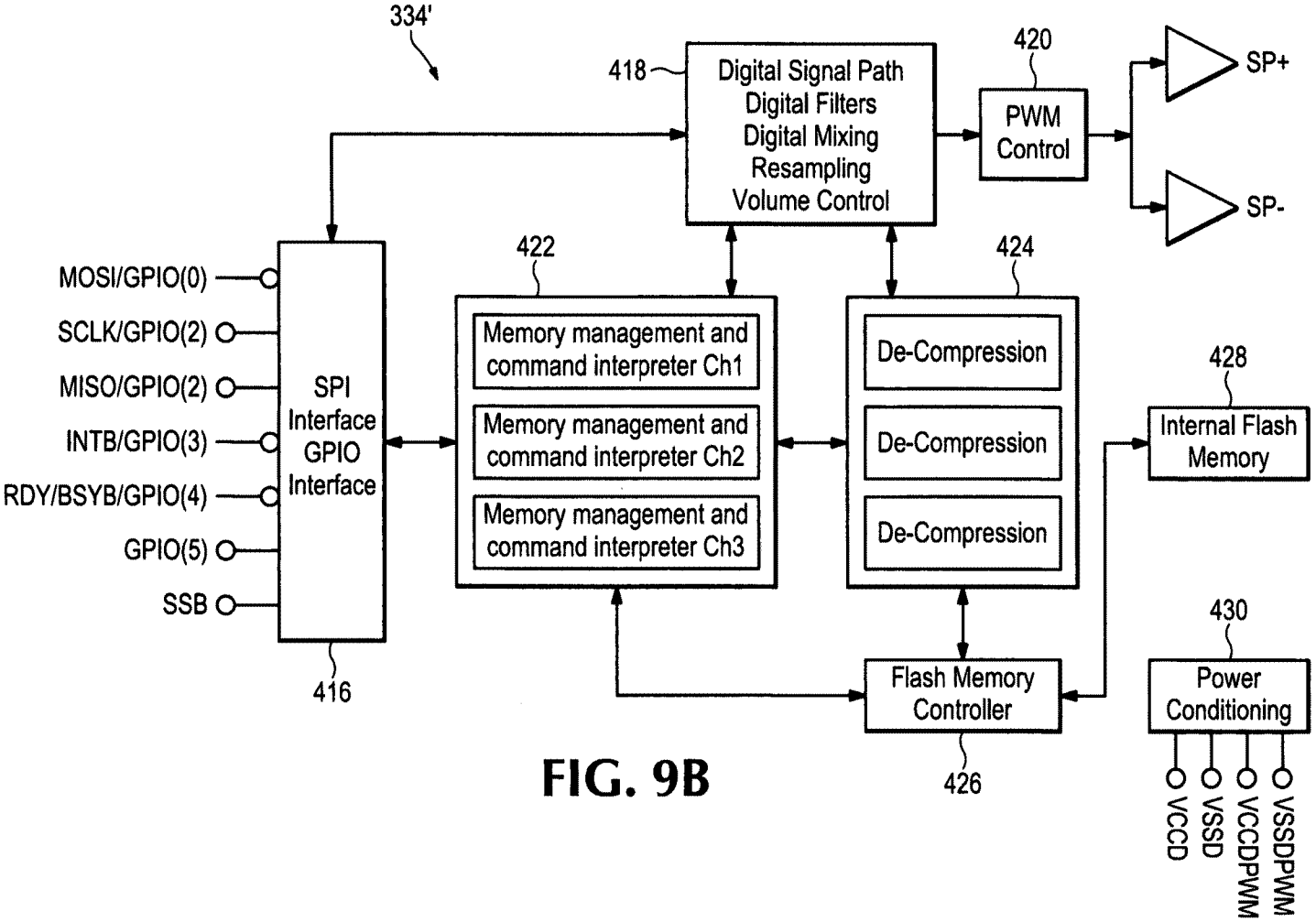

FIGS. 9A and 9B are a detailed schematic block diagram of the electromechanical aspects of the talking pill bottle label 10' and docking station 12' shown in FIGS. 7-8, as well as a USB-connected PC 402'. FIG. 9A shows that docking station 12' includes a USB-to-serial peripheral interface (SPI) interface 414 that converts the USB standard into the SPI standard. FIG. 9A also shows that talking label 10' includes an integrated circuit (IC) 334' connected to a PLAYback pushbutton 322' and a speaker 332' (which may be seen to have a slightly larger surface area, and thus is productive of more robust audible speech, than speaker 332). FIG. 9B shows IC 334' in more detail as including an SPI interface (GPIO interface) 416, a digital signal path 418 including digital filters, mixing, re-sampling and volume control, a pulse-width modulation (PWM) control 420, and speaker outputs SP+/SP−. IC 334' also includes a three-channel (only one of which is used in this alternative embodiment of talking pill bottle label 10') memory management and command interpreter 422 and corresponding de-compression circuitry 424. IC 334' also includes a flash memory controller 426 and one or more memories such as an internal flash memory 428. Finally, IC 334' includes a power conditioning circuit 430 with standard VCCD, VSSD, VCCSPWM and VSSDPWM power inputs. These elements of speech-synthesis IC 334' are believed to be understood by those of skill in the art.

Those of skill also will appreciate that one or more batteries are included in talking pill bottle 10', but that such batteries are not shown in FIG. 9A. Those of skill in the art also will appreciate that no battery is required to be included in docking station 12', since it derives its power conventionally via the USB port from PC 402'.

Those of skill in the art will appreciate that PC 402' is programmed to permit an operator thereof using a convenient graphic user interface (GUI) automatically to record a talking bottle label 10' via docking station 12'. The printed label information that already resides in the PC's memory is straightforwardly converted from text to speech via docking station 12' and talking label 10'. The capacity of flash memory 428 and the sampling rate are optimized in accordance with this alternative embodiment of the invention to permit at least approximately fifteen, a preferably at least approximately thirty, and more preferably at least approximately sixty (e.g. ~sixty-four) seconds of synthesized, digitized speech to be recorded in talking pill bottle label 10'. This means that talking pill bottle label 10' can record and audibly play back all of the printed label information that is typically required and/or recommended.

The sampling rate for recording a talking pill bottle label is programmable, and depends upon the available memory and the required length of the synthetic, digital speech record. Those of skill will appreciate that known compression algorithms can be used to achieve maximum flexibility. IC 334' can support sampling rates of 4, 5.3, 6.4, 8, 10.67, 12.8, 16, and 32 kilohertz (kHz). IC 334' also can support u-Law (6, 7, or 8 bits per sample), differential u-Law (6, 7, or 8 bits per sample), PCM (8, 10, or 12 bits per sample), enhanced ADPCM (2, 3, 4, or 5 bits per sample), or variable-bit-rate optimized compression (high quality, moderate, high compression). In accordance with the alternative embodiment of the invention described herein, sixty-four seconds of audible recording are provided based upon an 8 kHz sampling rate and 4-bit ADPCM compression. Those of skill in the art will appreciate that other sampling rates and compression algorithms are contemplated as being within the spirit and scope of the invention. PC 402' may straightforwardly be programmed automatically to adjust the sampling rate and compression algorithm in real time for a given patient/prescription based upon the length of the required recording. PC 402' executing the software application, docking station 12' converting the USB to a SPI interface, and talking label 10' converting digital text to synthesized digital recorded speech are collectively referred to herein as a label-programming mechanism.

The software application that executes on PC 402' takes typed or other patient/prescription data from the pharmacy technician, converts the textual prescription information to digital audio, compresses the digital audio, and transmits the compressed digital audio along with commands to docking station 12' into which talking pill bottle label 10' is docked. Those of skill in the art will appreciate that the software application could further store a .wav (digital audio file) of the original, uncompressed and/or compressed audio file to disk with a filename consisting of the Rx number and a time/date stamp, as might be required for mail-order customers. In accordance with one embodiment of the invention, the software application is straightforwardly coded using existing software tools and languages, and executes on a WINDOWS operating system (OS)-based PC 402'. Those of skill in the art will appreciate, however, that such a software application could be a web-based application to which registered customers obtain access after logging into an ACCESSAMED™ website. Thus, the software application would be platform-independent and easily updated and/or otherwise maintained and/or improved.

Those of skill in the art will appreciate that the software architectures described and illustrated herein can be implemented in any suitable cede by the use of any suitable coding and language tools. For example, any one or more of C++, XML, Flash, Actionscript, and SQL are a suitable suite of tools for coding the invented system and device software.

Figure 10:
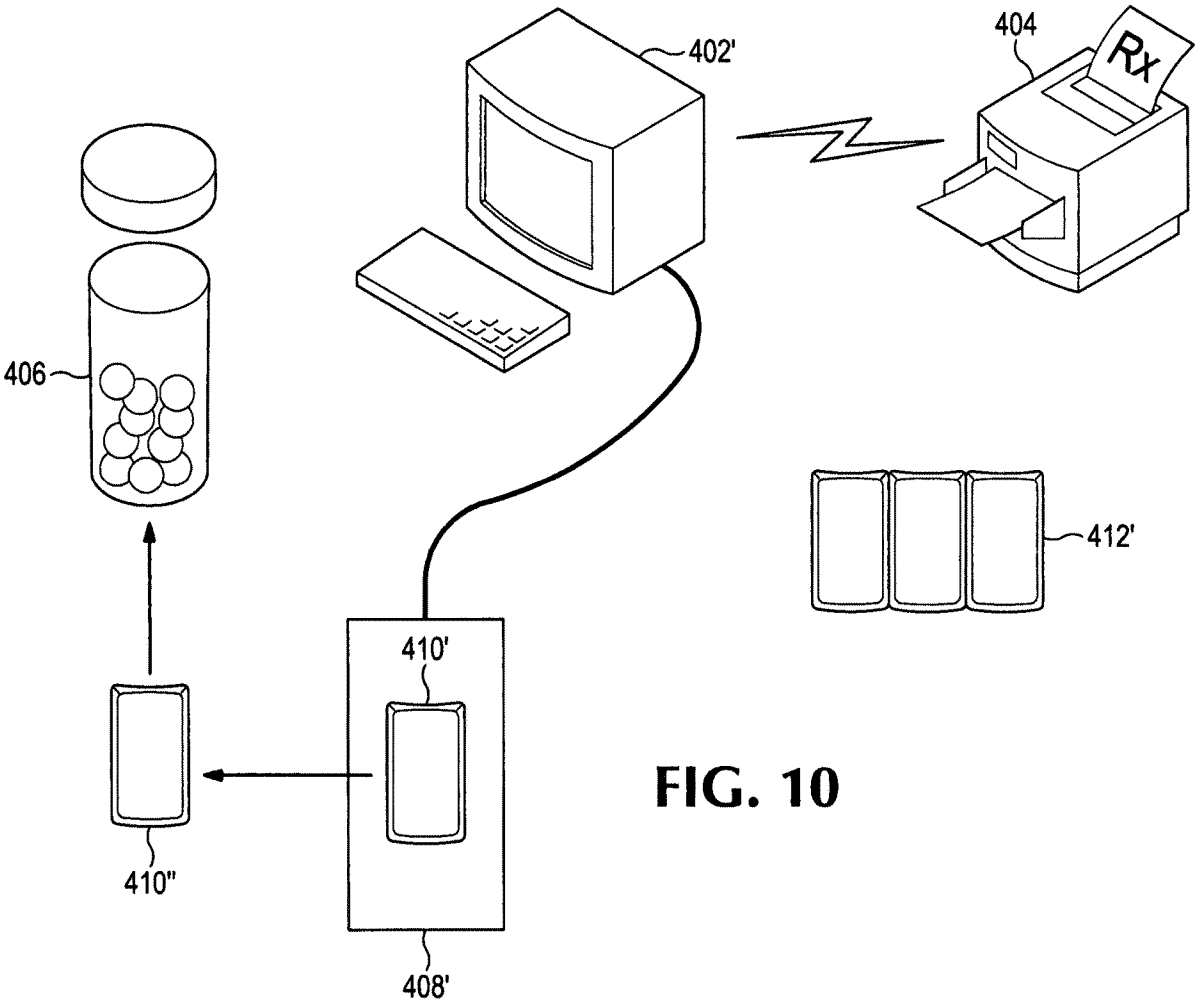
FIG. 10 is a system block diagram illustrating the system for manufacturing the talking medicine bottle's talking label and talking medicine bottle bearing such a talking label shown in FIGS. 7-8 in accordance with the alternative embodiment of the invention.

FIG. 10 is a system block diagram illustrating the system for manufacturing the talking medicine bottle's talking label and talking medicine bottle bearing such a talking label shown in FIGS. 7-8 in accordance with the alternative embodiment of the invention. The differences between FIG. 10 and FIG. 4 are few: 1) unrecorded labels 412' and 410' and recorded label 410" are of a different form factor and recording capacity and have a slightly different feature set;

2) docking station 408' is also of a different form factor and slightly different feature set; and 3) docking station 408' has a wired, e.g. USB, connection to PC 402'; and 4) no speaker is required since recording is automatic under control of application software residing and executing on PC 402'. Of course, the data format (not shown in FIG. 4 or 10) is also different, since PC 402', docking station 408', and talking pill bottle 10' are equipped to convert textual information to synthesized, digital speech information for audio recording in talking pill bottle 10'. Those of skill will appreciate that within the spirit and scope of the invention, the wired USB conveyance may instead take the form of a wireless conveyance such as a wireless router, infrared, RF, BlueTooth, or other suitable alternative.

Figure 11B:
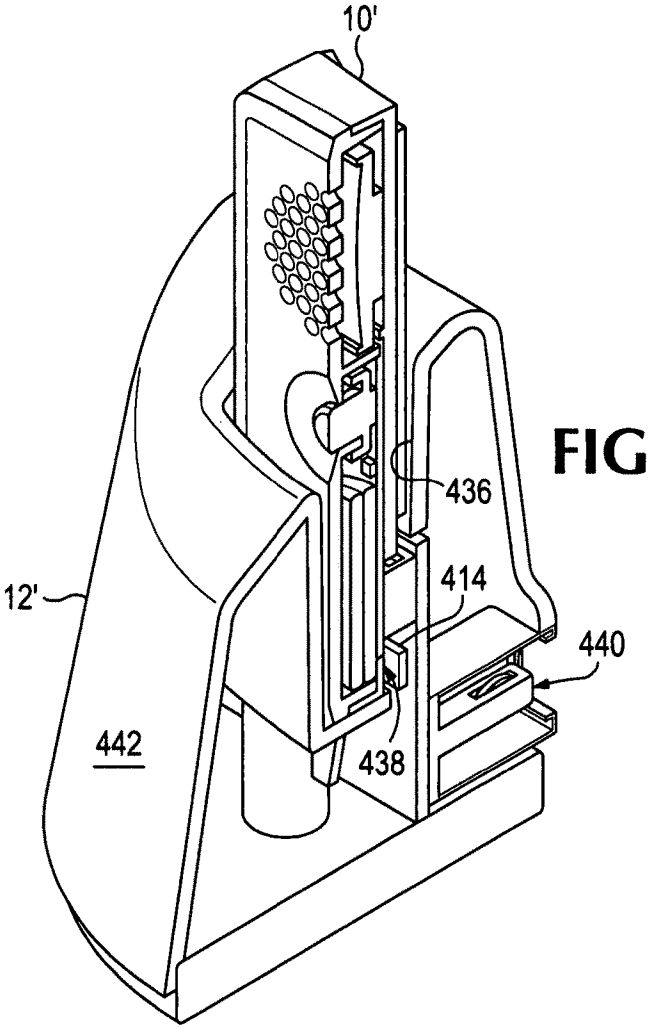
FIGS. 11A and 11B are rear and front cut-away isometric views of the invented talking label by itself and of the talking label ported for prescription-contents recordation in the recording device, respectively, in accordance with the alternative embodiment of the invention.
Figure 11A:
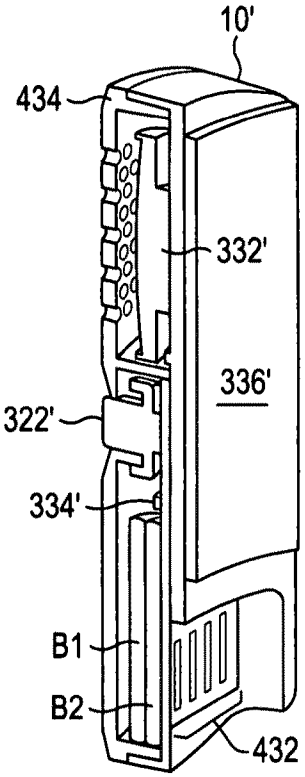

FIGS. 11A and 11B are cut-away isometric views of the invented talking label by itself and of the talking label ported for prescription-contents recordation in the recording device, respectively, in accordance with the alternative embodiment of the invention. FIG. 11A shows talking label 10' including recessed PLAYback pushbutton 322', speaker 332', IC 334' and associated circuitry, one or more, e.g. two, circular disk batteries B1 and B2, a recording-only edge connector array 432, and adhesive film 336', all fitted within a lightweight housing 434. (Not shown in FIG. 11A for the sake of clarity and brevity is a PCB that mounts the various electrical components including the connector array lands.) Those of skill in the art will appreciate that housing 434 is formed of two snap-fit (and optionally adhered or otherwise suitably joined and/or fastened) halves for assembly and battery-installation purposes. FIG. 11B shows talking label 10' docked within docking station 12' for recording purposes. Docking station 12' may be seen to include a recess 436 for receiving talking label 10' partway therein, a recording edge connector array 438 that is physically and electrically compatible with connector array 432, a Type B USB port 440 for wired connection with PC 402' during programming of talking label 10', and USB-to-SPI interface 414, all fitted within a lightweight housing 442.

In accordance with the alternative embodiment of the invention described above by reference to FIGS. 7-10 and 11A-11B, it will be appreciated that the functionality of talking pill bottle label 10' is greatly increased, while its form factor is similar and while its overall size increases only slightly. Those of skill in the art will appreciate that the overall height of label 10' is only approximately 6 cm (2 inches), that the overall width is only approximately 2.4 cm (0.94 inch), and that the overall thickness is only approximately 1.4 cm (0.55 inch). Thus, all of the speech functionality of invented talking label 10' fits in a volume that is less than approximately 24.5 $cm^3$ (1.5 $in^3$), preferably less than approximately 16.4 $cm^3$ (1 $in^3$), and more preferably less than approximately 13 $cm^3$ (0.8 $in^3$). It is this high functional density that enables a very capable talking label 10' to be used on a conventional pill bottle 16.

Those of skill in the art also will appreciate that it is contemplated as being within the spirit and scope of the invention to provide a custom pill bottle with an integrally molded pocket for accommodating a slightly differently configured talking label otherwise in accordance with the embodiments described and illustrated herein. For example, a custom pill bottle may be provided with a pocket extending along an outer surface, the pocket being formed and fitted to accommodate a differently configured talking label therein. In such case, the talking label would take an overall more planar form with dual, planar, opposing outer surfaces instead of a curved inner surface, and it could simply be inserted into the conforming pocket of the custom pill bottle, e.g. with a snap- or interference-fit to obviate the use of an adhesive layer as may be required by the use of conventional pill bottles. Thus talking label 10 may take an alternative, relatively planar form in which its outer surfaces are also planar and conform to a planar recess formed as a pocket within a custom pill bottle. The added cost to the bottle would be minimal, the cost of the label might decrease, and a more comprehensive, common solution for bottles of various sizes would be provided.

Those of skill in the art will also appreciate that further alternative customized integral talking medicine bottles are contemplated as being within the spirit and scope of the invention. For another example, a differently configured voice module or so-called talking label can be affixed or otherwise incorporated within the circular recess of a custom pill bottle's base or cap. Such a reconfiguration of the talking label thus would involve configuring the PCB-mounted electrical circuit components into a preferably circular, disk-shaped assembly that could be very simply accommodated within the pill bottle's base's recess or within the pill bottle's lid's recess, which recess could be made dimensioned depth-wise to readily accommodate the voice module or talking label therein for a snap- or interference-fit or via the use of a circular adhesive layer that is similarly circularly configured. Those of skill will appreciate that the talking label of such a different shape but otherwise containing the same functions and features described and illustrated herein could be docked with a compatibly reconfigured docking platform or recording device otherwise in accordance with the recording device described and illustrated herein Any such alternative speech module and talking label configurations in which the voice module is integrated on or within a pill bottle or on or within a pill bottle lid are contemplated as being within the spirit and scope of the invention The advantages represented by the invention can now be readily appreciated. A relatively simple and inexpensive talking medication bottle label and a method and system for its manufacture enables a pharmacy to make reasonable accommodations at reasonable cost for the millions of subscription medication patients/users who either cannot read printed labels for whatever reason, whether they are unable to read, not conversant in the host language, or B/VI. The invention does so by placing only needed functionality within the talking label itself, while providing an inexpensive and passive recording device capable of programming one or more of various prescriptions. The invention does so without undue effort on the part of pharmacy personnel. Finally, the invention does so with a simple-to-use pushbutton for the patient's repeated in-home use.

It will be understood that the present invention is not limited to the method or detail of construction, fabrication, material, application or use described and illustrated herein. Indeed, any suitable variation of fabrication, use, or application is contemplated as an alternative embodiment, and thus is within the spirit and scope, of the invention.

It is further intended that any other embodiments of the present invention that result from any changes in application or method of use or operation, configuration, method of manufacture, shape, size, or material, which are not specified within the detailed written description or illustrations contained herein yet would be understood by one skilled in the art, are within the scope of the present invention.

Finally, those of skill in the art will appreciate that the invented method, system and apparatus described and illustrated herein may be implemented in software, firmware or hardware, or any suitable combination thereof. Preferably, the method system and apparatus are implemented in a combination of the three, for purposes of low cost and flexibility. Thus, those of skill in the art will appreciate that embodiments of the methods and system of the invention may be implemented by a computer or microprocessor process in which instructions are executed, the instructions being stored for execution on a computer-readable medium and being executed by any suitable instruction processor.

Accordingly, while the present invention has been shown and described with reference to the foregoing embodiments of the invented apparatus, it will be apparent to those skilled in the art that other changes in foam and detail may be made therein without departing from the spirit and scope of the invention as defined in the appended claims.

We claim:

1. A talking label system for a prescription medicine bottle, comprising one or more labels, a label-programming mechanism, and a docking station;

each label configured to adhere to a corresponding shape of lidded container and including an audible-speech module, each audible-speech module including: a memory configured to receive, store and selectively to play out a prescription message of at least sixty seconds duration; a label communications port; one or more rechargeable battery cells; a speaker; and, a manually-operable playback switch;

the label-programming mechanism electronically couplable to the docking station via a communications link, the label-programming mechanism comprising including software for converting a digital text file to a digital audio file containing a corresponding prescription message;

the docking station comprising a communications interface couplable to the label-programming mechanism via the communications link and to a label communications port, to thereby permit transferring the digital audio file from the label-programming mechanism to the label audible-speech module memory for playback through the audible-speech module speaker.

2. The system of claim 1, further comprising:

each of the labels further including a first connector portion electronically connected to the audible-speech module; and, wherein the docking station further comprises a slot configured to receive a label therein, the slot including a second connector portion to engage the label first connector portion and thereby connect the label to the label-programming mechanism via the communications interface and communications link.

3. The system of claim 1, further comprising:

wherein the docking station communications interface coupling to a label communications port is a wireless coupling.

4. The system of claim 3, wherein the docking station wireless communications interface coupling to a label communications port is selected from the group of: radio frequency data link and infrared data link.

5. The system of claim 1, further comprising:

the label-programming mechanism further including a microphone and software for converting verbal content spoken into the microphone into a digital file for storage and transfer via the communications link, docking station communications interface and a label communications port to a label audible-speech module memory for playback through the audible-speech module speaker.

6. The system of claim 2, further comprising:

the label-programming mechanism further including a microphone and software for converting verbal content spoken into the microphone into a digital file for storage and transfer via the communications link, docking station communications interface and a label communications port to a label audible-speech module memory for playback through the audible-speech module speaker.

7. The system of claim 3, further comprising:

the label-programming mechanism further including a microphone and software for converting verbal content spoken into the microphone into a digital file for storage and transfer via the communications link, docking station communications interface and a label communications port to a label audible-speech module memory for playback through the audible-speech module speaker.

* * * * *